United States Patent [19]

Staggs

[11] 3,946,450

[45] Mar. 30, 1976

[54] BED-MAKING DEVICE

[76] Inventor: Alvin D. Staggs, P.O. Box 778, Buckley, Wash. 98321

[22] Filed: Feb. 24, 1975

[21] Appl. No.: 552,445

[52] U.S. Cl. ..... 5/317 R
[51] Int. Cl.[2] ..... A47C 21/00
[58] Field of Search ..... 5/60, 317 R, 321; 108/90; 297/283

[56] References Cited

UNITED STATES PATENTS

| | | | |
|---|---|---|---|
| 805,805 | 11/1905 | Loose | 297/283 X |
| 942,606 | 12/1909 | Wilson | 5/317 R |
| 1,237,170 | 8/1917 | Cline | 108/90 |
| 1,273,953 | 7/1918 | Torano | 297/283 |
| 3,343,183 | 9/1967 | Sannes | 5/317 R |
| 3,388,406 | 6/1968 | Scrivener | 5/317 R |

*Primary Examiner*—James C. Mitchell
*Attorney, Agent, or Firm*—Fishburn, Gold & Litman

[57] ABSTRACT

A bed-making device is operative to automatically prepare a bed for use by removing a bedspread from a top surface of a mattress and placing a bottom sheet and top sheet and a pillow or pillows on the top surface of the mattress and to remove same and replace the bedspread on the top surface of the mattress when the bed is not in use. The bed-making device includes a support structure having a head chamber and a foot chamber positioned adjacent respective ends of the mattress. A first or head roller is positioned in the head chamber and a second or foot roller is positioned in the foot chamber. A web is in sliding engagement with a top surface of the mattress and is operably associated with the head and foot rollers. The bedspread has an end thereof connected to the web, and the bottom sheet and top sheet each have one end thereof removably connected to the web adjacent the one end of the bedspread, whereby the bedspread is moved onto the mattress and the sheets are moved into the head chamber when the head roller is rotated to move the web in one direction, and the sheets are moved onto the mattress when the foot roller is rotated to move the web in an opposite direction. Pillows may also be moved into and out of storage as the sheets are moved.

7 Claims, 7 Drawing Figures

1
27
28
7
29
40'
16
42
43
36
35
19'
40
37
5
19
25
9
6
4
39
11
12
38
10
23
22
2
8
34
15
3
26
14
24
32
33

1
26
20
48
47
34
25
49
14
42
4
19
3
10
38
29
50
51
52
39
37
19'
5
17
17'
40'
6
5.
5.
31
9
46
28
18
18'
16
36
27
35
43
43'
2
44
8
45
21
26
15
33
34

1
25
31
29
42
43
43'
19'
35
36
40'
30
11
37
19
16
3
4
40
6
17'
18'
39
38
5
46
49
12
48
41
47
23
22
2
8
41'
7
52
20
21
33
14
24
32
15

BED-MAKING DEVICE

The present invention relates to bed-making devices and more particularly to a bed-making device operative to automatically prepare a bed for use by removing a bedspread from a top surface of a mattress and placing a bottom sheet and a top sheet on the top surface of the mattress and to automatically remove same and replace the bedspread on the top surface of the mattress when the bed is not in use.

The principal objects of the present invention are: to provide a bed-making device operative to automatically prepare a bed for use and to automatically replace a bedspread when the bed is not in use; to provide such a bed-making device operative to remove a bedspread from a top surface of a mattress and place a bottom sheet, top sheet, and pillow or pillows on the top surface of the mattress and to automatically remove same and replace the bedspread on the top surface of the mattress when the bed is not in use; to provide such a bed-making device operative to place the bottom sheet, top sheet, and a blanket or blankets on the upper surface of the mattress substantially free of wrinkles; to provide such a bed-making device operative to fluff a pillow or pillows during replacing same on the sheets on top of the mattress; to provide such a bed-making device having a headboard adapted to support a pillow or pillows when in use and operative to retract to permit pillow or pillows, sheets, and a blanket or blankets to move into a head cavity or chamber; to provide such a bed-making device wherein the sheets and blanket or blankets and bed-spread are each respectively removably connected to a web extending between a head roller and a foot roller whereby same may be removed and replaced with clean and fresh items; and to provide such a bed-making device which is attractive in appearance, durable in construction, positive in operation, and particularly well adapted for the proposed use.

Other objects and advantages of this invention will become apparent from the following description taken in connection with the accompanying drawings wherein are set forth by way of illustration and example certain embodiments of this invention.

The drawings constitute a part of the specification and include an exemplary embodiment of the present invention and illustrate various objects and features of the bed-making device.

Figure 1:
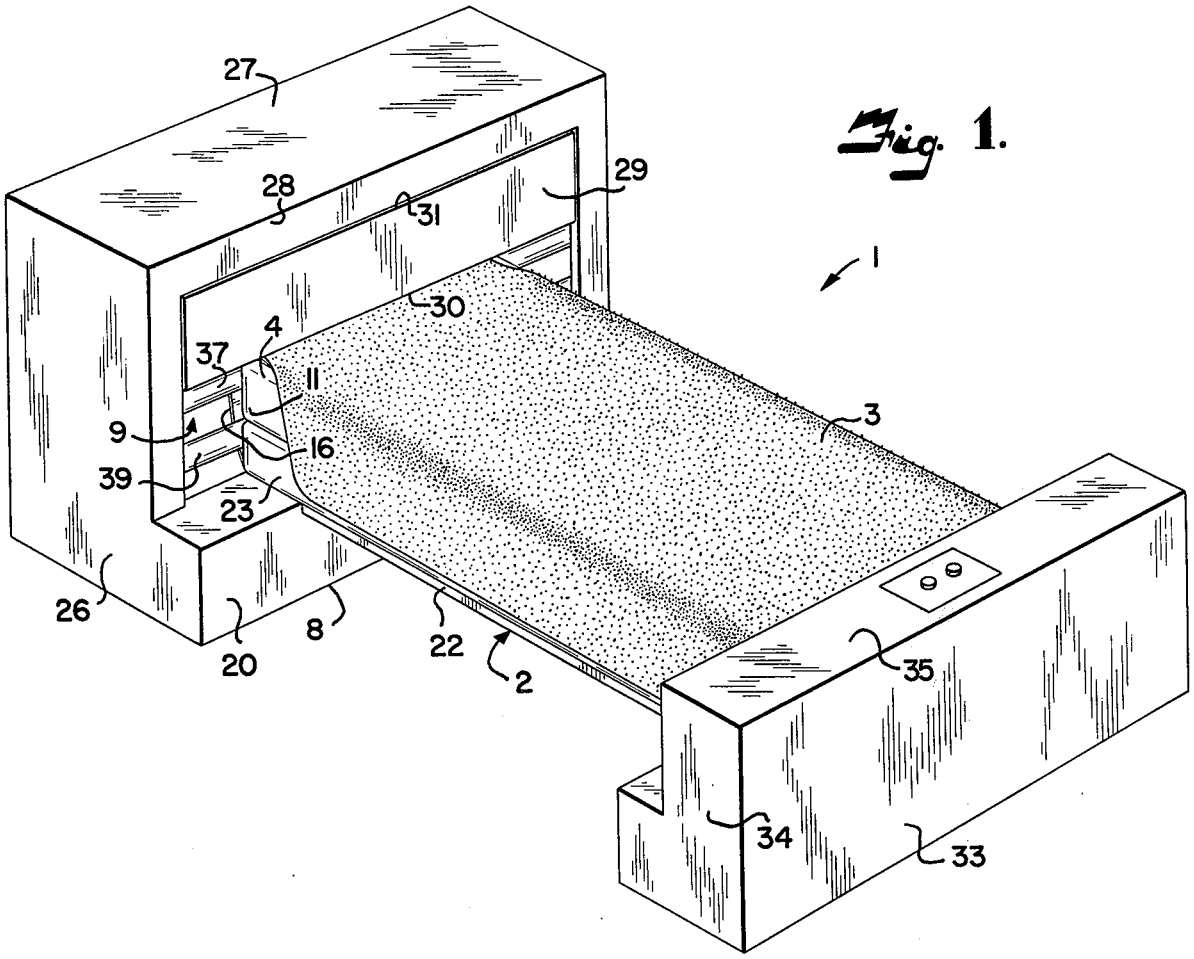
FIG. 1 is a perspective view of a bed-making device embodying features of the present invention.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

In the disclosed embodiment of the present invention, the reference numeral 1 generally designates a bed-making device which is operative to automatically prepare a bed 2 for use by removing a bedspread 3 from a top surface of a mattress 4 and placing a bottom sheet 5, top sheet 6, and a pillow or pillows 7 on the top surface of a mattress 4 and to remove same and replace the bedspread 3 on the top surface of the mattress 4 when the bed 2 is not in use. The bed-making device 1 includes a support structure 8 having a head chamber 9 and a foot chamber 10 positioned at respective opposite ends 11 and 12 of the mattress 4. A first or head roller 14 is positioned in the head chamber 9 and a second or foot roller 15 is positioned in the foot chamber 10. A web 16 is in sliding engagement with a top surface of the mattress 4 and has respective opposite ends thereof in operative engagement with the head and foot rollers 14 and 15 and the bedspread 3 has respective opposite ends thereof removably connected to the web 16 and the bottom and top sheets 5 and 6 have one ends 17 and 18 thereof respectively connected to the web 16 adjacent one end 19 of the bedspread 3 whereby the bedspread 3 is moved onto the mattress 4 and the sheets 5 and 6 and pillow or pillows 7 are moved into the head chamber 9 when the head roller 14 is rotated to move the web 16 in one direction and the sheets 5 and 6 and pillow or pillows 7 are moved onto the mattress 4 when the foot roller 15 is rotated to move the web 16 in an opposite direction.

The support structure 8 has longitudinally spaced and upstanding head and foot support walls 20 and 21 respectively with a deck 22 extending therebetween for supporting and retaining box springs 23 thereon. The mattress 4 is positioned on the box springs 23 in the conventional manner.

The head chamber 9 of the support structure 8 includes a base wall 24 extending from the head support wall 20 and in engagement with a floor surface. An upstanding head wall 25 extends upwardly from the base wall 24 and is spaced outwardly from the head support wall 20 and the head end 11 of the mattress 4. The head chamber 9 includes opposite end walls 26 to close opposite ends of the head chamber 9 and to enclose operative components therein, as later described. A top wall 27 extends from the head wall 25 and has one edge 28 thereof substantially aligned with the head end 11 of the mattress 4.

Figure 2:
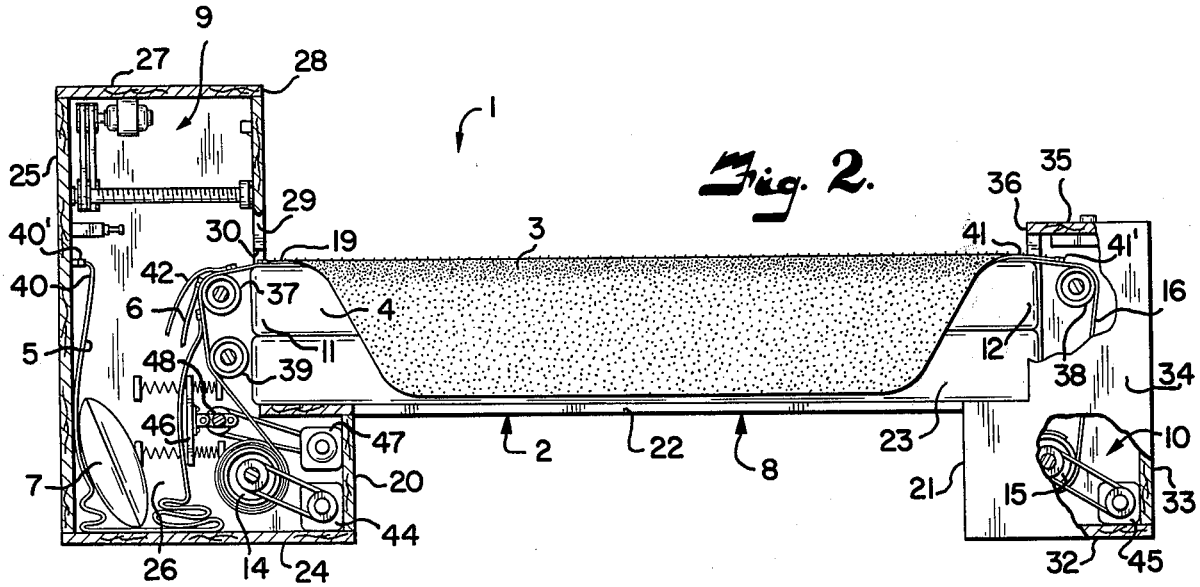
FIG. 2 is a side elevational view of the bed-making device with portions broken away to show operative components thereof and shown with a bedspread in place on a mattress.

A headboard 29 is movably mounted on the head wall 25 and includes suitable extensible means which is power operated for extension and retraction of the headboard 29. In an extended position, as best seen in FIG. 2, the headboard 29 has a lower edge 30 positioned adjacent the head end 11 of the mattress 4 and an upper edge 31 positioned adjacent the one edge 28 of the top wall 27 to thereby close the head chamber 9 and provide a support for the pillow or pillows 7.

The foot chamber 10 of the support structure 8 includes a base wall 32 extending from the foot support wall 21 and engaging the floor surface. An upstanding foot wall 33 extends upwardly from the base wall 32 and is spaced outwardly from the foot end 12 of the mattress 4. End walls 34 close opposite ends of the foot chamber 10 and enclose the operative components therein, as later described. The top wall 35 extends from the foot wall 33 and has one edge 36 substantially aligned with and slightly above the foot end 12 of the mattress 4. The spacing between the one edge 36 of the top wall 35 and the foot end 12 of the mattress 4 is preferably a minimum spacing to permit movement of the web 16 and the bedspread 3 thereon between the edge 36 and the foot end 12.

Figure 4:
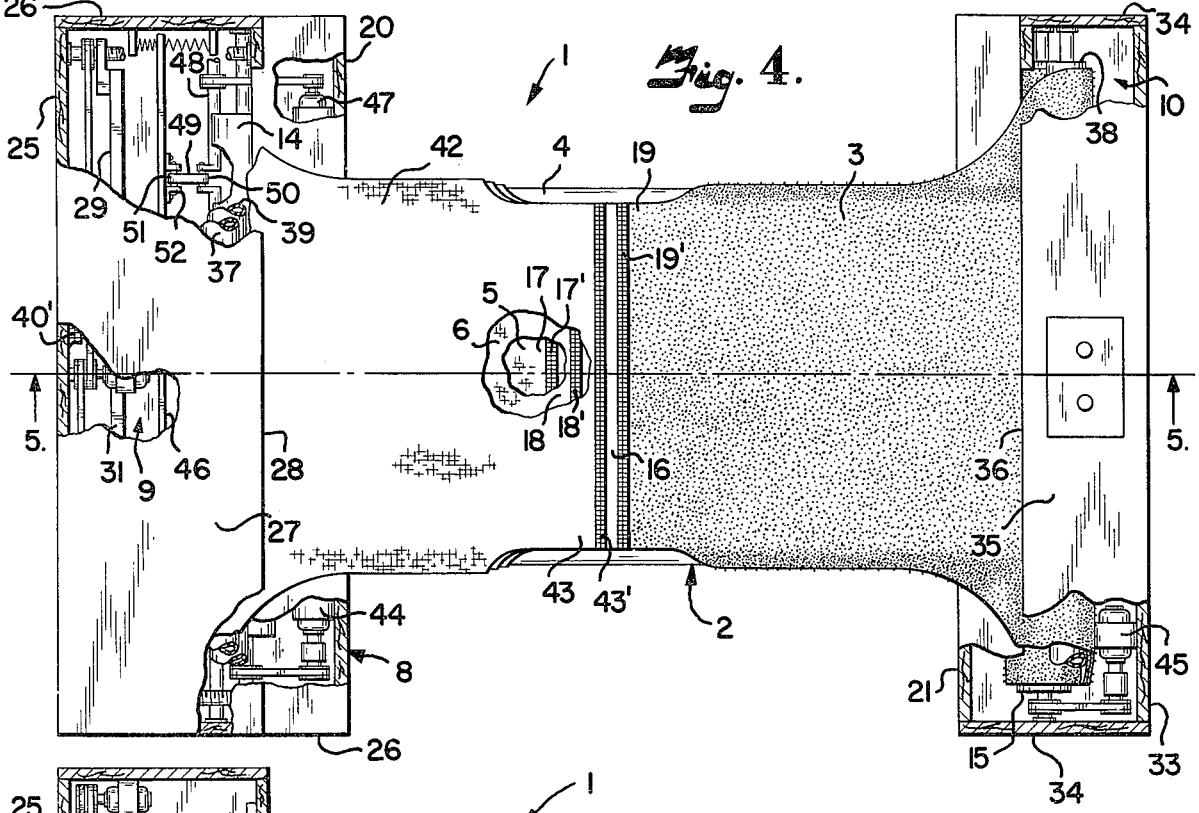
FIG. 4 is a top plan view of the bed-making device.
Figure 5:
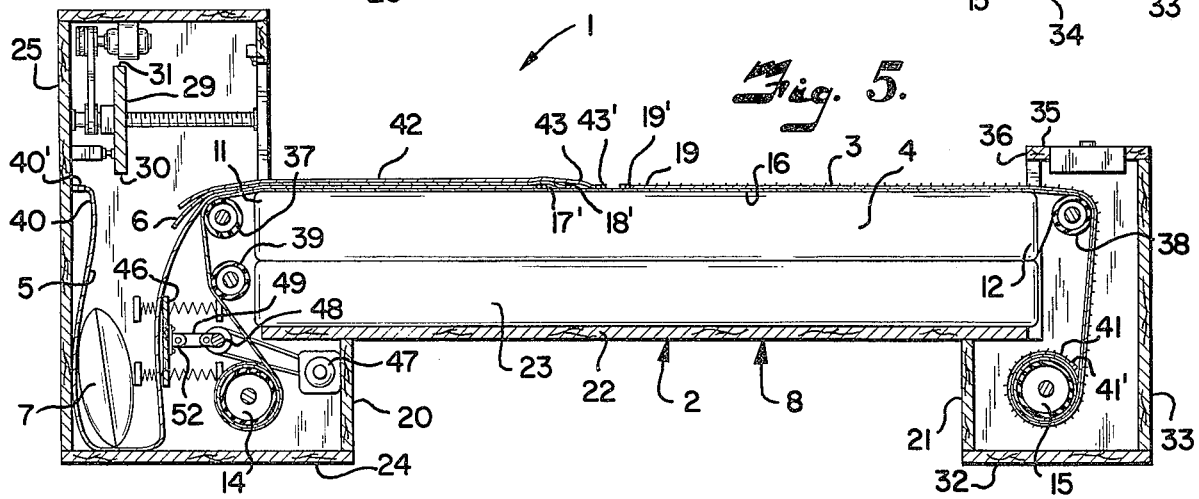
FIG. 5 is a longitudinal sectional view of the bed-making device and taken on line 5—5, FIG. 4.

The head and foot rollers 14 and 15 are positioned in the head and foot chambers 9 and 10 respectively and the web 16 extends therebetween. In the illustrated structure, the head and foot rollers 14 and 15 are positioned below a top or upper surface of the mattress 4, therefore, direction changing rollers 37 and 38 are positioned adjacent the head end and foot end 11 and 12 respectively of the mattress 4. In order to conserve space, the head roller 14 is positioned below the box springs 23 and the mattress 4 and, therefore, a second direction changing roller 39 is positioned in the head chamber 9 to direct the web 16 toward the head roller 14. As illustrated in FIGS. 1 and 4, the head chamber and foot chamber and the rollers 14, 15, 37 and 38 are of lengths greater than the width of the mattress 4 and such that they accommodate the width of the web, sheets and bedspread.

The bottom sheet or second web 5 has the one end 17 thereof connected to the web 16 adjacent the one end 19 of the bedspread 3. An other end 40 of the bottom sheet or second web 5 is removably connected to the upstanding head wall 25 of the head chamber 9 at a position substantially coplanar with the top or upper surface of the mattress 4. A pillow or pillows 7 on the top sheet 6 and on the second web or bottom sheet 5 will be moved into the head chamber 9 with the sheets when the head roller 14 rotates to move the web 16 in one direction and the sheets and pillows will be moved onto the mattress 4 when the foot roller 15 rotates to move the web 16 in the opposite direction, as later described.

The second web 5 has a width at least equal to the width of the mattress 4 and preferably greater so that side portions thereof cover the sides of the box springs 23 and the mattress 4. Each of the ends 17 and 40 of the bottom sheet 5 are removable whereby the bottom sheet 5 may be removed and laundered for replacement in the bed-making device. Zippers 17' and 40' have been found to be particularly effective for attaching and removing the bottom sheet 5.

The bedspread 3, as best seen in FIG. 2, is on the mattress 4 when the bed 2 is not in use. The bedspread 3 has opposite ends thereof removably connected to the web 16 and in the illustrated structure, the one end 19 of the bedspread 3 is adjacent the one end 17 of the bottom sheet 5. An other end 41 of the bedspread 3 is positioned adjacent the foot roller 15. The bedspread 3 has a length sufficient to position the other end 41 thereof under the top wall 35 of the foot chamber 10 while the one end 19 thereof is positioned under the top wall 27. The bedspread 3 has a width at least equal to and preferably greater than the width of the mattress 4 to thereby cover the upper or top surface of the mattress 4 and side portions of the box springs 23 and mattress 4. The side portions of the bedspread 3 are also preferably in covering relation with edge portions of the web 16. The connections of the bedspread 3 to the web 16 at the ends 19 and 41 thereof are each preferably removable, as by zippers 19' and 41', whereby the bedspread 3 may be removed for laundering and replacement.

The top sheet 6 has the one end 18 thereof removably connected to the web 16 between the one end 17 of the bottom sheet 5 and the one end 19 of the bedspread 3, as by a zipper 18'. The other end of the top sheet 6 is free and is positioned adjacent the head end 11 of the mattress 4 when positioned on the mattress. The top sheet 6 has a width at least equal to and preferably greater than the mattress 4 so that side edge portions thereof cover respective side edge portions of the box springs 23 and the mattress 4.

The bed-making device 1 may have one or more blankets 42 each having one end 43 removably connected to the web 16, as by a zipper 43', between adjacent ends of the sheets and bedspread. The blanket 42 has the other end thereof free and is also positioned adjacent the head end 11 of the mattress 4 when in position on the mattress 4. The blanket 42 has a width at least equal to and preferably greater than the width of the mattress 4 so that the side portions of the blanket 42 cover respective side portions of the bottom sheet 5, top sheet 6, and the box springs 23 and mattress 4.

Suitable drive means are operatively connected to the head roller 14 and the foot roller 15. In the illustrated structure, suitable electric motors 44 and 45 are positioned in the head chamber 9 and the foot chamber 10 respectively. The drive motors 44 and 45 preferably have suitable clutch means to disengage one drive motor when the other drive motor is in operation. The bed-making device 1 includes a suitable switch or switches on the support structure 8 operative to complete respective portions of an electrical circuit (not shown) to selectively energize one of the motors 44 or 45 or disengage both motors.

The bed-making device 1 includes means in the head chamber 9 and positioned adjacent the head end 11 of the mattress 4 for shaking the bottom sheet 5 and thereby the top sheet 6 to permit the bottom sheet 5 and the top sheet 6 to move onto the upper surface of the mattress 4 substantially wrinkle-free. Shaking of the bottom sheet 5 is effective to shake and fluff the pillow or pillows 7 retained on the second web or bottom sheet 5.

In the illustrated structure, a planar member 46 is positioned in the head chamber 9 between the head roller 14 and the upstanding head wall 25. The planar member 46 is positioned below the direction changing roller 37 and the second direction changing roller 39. The planar member 46 is generally vertical or near vertical and has opposite ends thereof preferably resiliently supported on the end walls 26 of the head chamber 9.

Suitable means are operatively connected to the planar member 46 to shake same or move the planar member 46 toward and away from the head end 11 of the mattress 4. A suitable drive motor 47 is positioned in the head chamber 9 and is operative to rotate a crankshaft 48 having a pair of links 49 each having one end 50 thereof pivotally connected to the crankshaft 48 at respective positions spaced from the axis thereof. The other ends 51 of the links 49 are pivotally connected to suitable brackets 52 mounted on and extending from the planar member 46 whereby rotation of the crankshaft 48 is effective to move the planar member 46 toward and away from the head wall 25 thereby moving same into and out of engagement with the bottom sheet 5 during movement of the web 16 to place the sheets 5 and 6 and blanket 42 on the mattress 4.

Figure 3:
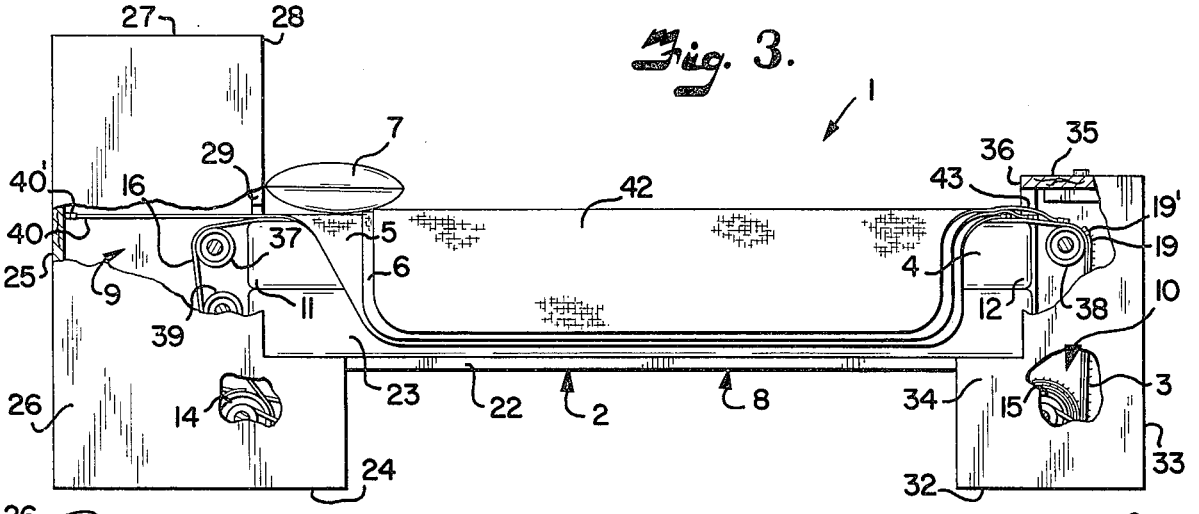
FIG. 3 is a side elevational view of the bed-making device with portions broken away to show the operative components thereof and shown with sheets and pillow or pillows in place on the mattress.

Use of the bed-making device illustrated and described herein is extremely simple and positive. When the bedspread 3 is in place on the mattress 4 and use of the bed is desired, the drive motor 45 is energized to rotate the foot roller 15 to move the web 16 toward the foot roller 15 thereby moving the bedspread 3 onto the foot roller 15. The bottom sheet 5, top sheet 6, blanket 42, and the pillow or pillows 7 are simultaneously moved onto the mattress. The bottom sheet 5 is moved to a position as shown in FIG. 3. The headboard 29 is retracted upon energizing the drive motor 45 to permit the pillow or pillows 7 to be moved onto the mattress 4 and then the headboard 29 is extended to permit the pillow or pillows 7 to be placed in engagement therewith. The drive motor 47 is energized to effect movement of the planar member 46 during movement of the web 16 and the bottom sheet 5, top sheet 6, blanket or blankets 42, and the pillow or pillows 7 onto the mattress to thereby remove the wrinkles in the bedding and to fluff the pillow or pillows 7.

When the bedspread 3 is to be replaced on the mattress 4, the drive motor 44 for the head roller 14 is energized to move the web 16 toward the head roller 14 thereby moving the pillow or pillows 7, bottom sheet 5, top sheet 6, and blanket or blankets 42 into the head chamber 9 and moving the bedspread 3 onto the upper or top surface of the mattress 4. The headboard 29 is retracted upon energizing the drive motor 44 to permit the pillow or pillows 7 and the sheets 5 and 6 and the blanket or blankets 42 to move into the head chamber 9 then the headboard 29 is extended after the head roller 14 stops to thereby provide a completed appearance for the bed-making device 1.

Figure 6:
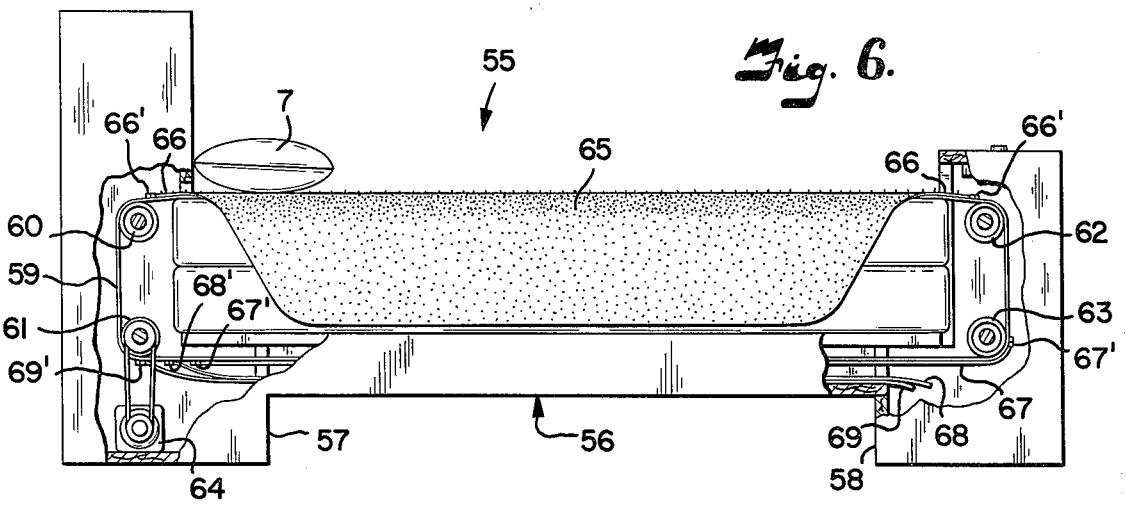
FIG. 6 is a side elevational view of a modified bed-making device with an endless web.
Figure 7:
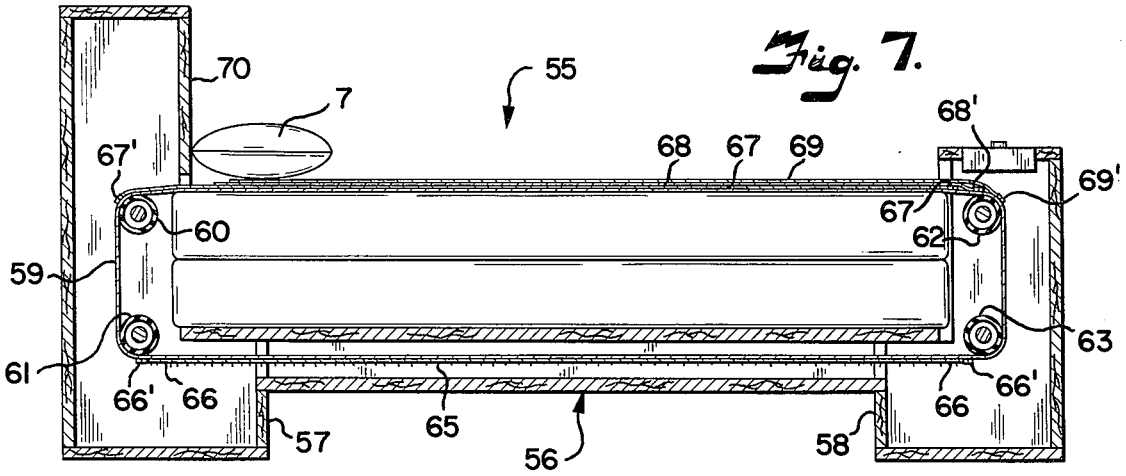
FIG. 7 is a longitudinal sectional view of the modified bedmaking device.

FIGS. 6 and 7 illustrate a modified bed-making device 55 wherein a support structure 56 therefor has longitudinally spaced head and foot support walls 57 and 58 respectively. The support walls 57 and 58 each have a suitable aperture therein adapted to permit an endless web 59 to pass therethrough.

The modified bed-making device 55 includes upper and lower head rollers 60 and 61 respectively positioned adjacent a head end of the mattress 4. Upper and lower foot rollers 62 and 63 respectively are positioned adjacent the foot end of the mattress 4. A suitable drive motor 64 is operatively connected to one of the lower head roller 62 or lower foot roller 63 to move the endless web 59 in one direction only, such as toward the foot roller.

A bedspread 65 is removably connected to the endless web 59 at opposite ends 66 thereof, as by zippers 66′. A bottom sheet 67 is removably connected to endless web 59 at opposite ends thereof as by zippers 67′. A top sheet 68 and one or more blankets 69 each have one end thereof removably connected to the endless web 59, as by zippers 68′ and 69′ respectively and each positioned adjacent the one end of the bedspread 65 and extending therefrom. The pillow or pillows 7 are manually removed and replaced on the modified bed-making device 55 adjacent or in engagement with a headboard 70.

Use of the modified bed-making device 55 is substantially similar to use of the bed-making device 1 except that the web 59 moves in only one direction and the bedspread 65 is only connected at one end thereof. The drive motor 64 is energized to move an upper portion of the endless web 59 toward the foot end of the mattress. The drive motor 64 is selectively stopped to position the bedspread 65 at a desired location on the mattress 4 when the bed is not in use. The drive motor 64 is energized to move the bedspread 65 to a storage position below the box springs 23 and the drive motor 64 is selectively stopped to position the sheets 67 and 68 and the blanket or blankets 69 at a desired location on the mattress 4. The pillow or pillows 7 must be manually removed and replaced when using the modified bed-making device 55.

It is to be understood that while I have illustrated and described certain forms of my invention, it is not to be limited to these specific forms or arrangement of parts herein described and shown.

What I claim and desire to secure by letters patent is:

1. A bed-making device comprising:

a. a support structure having a head end and foot end, said support structure being adapted to support thereon a mattress;

b. spaced connected walls adjacent the head end defining a head chamber wider than the mattress;

c. spaced connected walls adjacent the foot end defining a foot chamber wider than the mattress;

d. a first roller in the head chamber and a second roller in the foot chamber, said rollers each having a length greater than the width of the mattress;

e. a web having respective opposite ends thereof operatively associated with said first roller and said second roller and extending longitudinally over the mattress;

f. a bedspread having opposite ends thereof removably connected to said web at respective longitudinally spaced apart locations, said bedspread having a greater width than the mattress to hang over sides thereof when overlying the mattress; and g. at least one sheet having one end thereof removably connected to said web adjacent one end of said bedspread and movable into the head chamber when said first roller rotates in one direction and longitudinally onto the mattress when said first roller rotates in an opposite direction, said bedspread moving into the foot chamber as said one sheet moves onto the mattress.

2. A bed-making device as set forth in claim 1 including a second web having one end thereof connected to one of said spaced walls defining a head chamber and the other end thereof removably connected to said first named web adjacent the connection of said sheet to said first named web whereby a pillow on said sheet and on said second web will be moved into the head chamber with said sheet when said first roller rotates in the one direction and onto the sheet and mattress when said first roller rotates in the opposite direction.

3. A bed-making device as set forth in claim 1 including:

a. a second web having one end thereof removably connected to one of said spaced walls defining a head chamber and the other end thereof removably connected to said first named web adjacent the connection of said sheet to said first named web, the connection of the one end of said second web to said one of said spaced walls defining the head chamber being at a location spaced from a head end of the mattress and substantially parallel thereto; and b. means in the head chamber and adjacent the head end of the mattress and including an elongate member movably engaging said second web substantially across the width thereof for shaking said second web and thereby said sheet to permit said second web and said sheet to move onto the mattress substantially wrinkle free.

4. A bed-making device as set forth in claim 2 including a headboard movably mounted on said spaced walls defining the head chamber and movable between a retracted position to permit movement of the pillow into the head chamber and an extended position adjacent a head end of the mattress to permit the pillow to be positioned on the sheet and in engagement with said head board.

5. A bed-making device as set forth in claim 2 including:

a. shaker means mounted in the head chamber and adjacent the head end of the mattress and including a motor driven oscillating member movably engaging said second web for shaking said second web and thereby said sheet to permit said second web and said sheet to move onto the mattress substantially wrinkle free, shaking said second web being effective to shake the pillow retained on said second web; and b. a headboard movably mounted on said spaced walls defining the head chamber and movable between a retracted position to permit movement of the pillow into the head chamber and an extended position adjacent a head end of the mattress to permit the pillow to be positioned on the mattress and in engagement with said headboard.

6. A bed-making device as set forth in claim 1 wherein:

a. said spaced walls defining the head chamber includes one wall spaced outwardly from a head end of the mattress and substantially parallel thereto;

b. a second web has one end thereof removably connected to said one wall of said head chamber and the other end thereof removably connected to said first named web adjacent the connection of said sheet to said first named web;

c. the connection of said second web to said one wall of the head chamber is substantially coplanar with a top surface of the mattress; and d. a headboard is movably mounted on said one wall of the head chamber and movable between a retracted position to permit movement of a pillow into the head chamber and an extended position adjacent a head end of the mattress to permit the pillow to be positioned on the mattress and in engagement with said headboard.

7. A bed-making device as set forth in claim 6 including means in the head chamber and adjacent the head end of the mattress and including an elongate planar member movably engaging said second web substantially across the width thereof and motor means operatively connected thereto for shaking said second web and thereby said sheet to permit said second web and said sheet to move onto the mattress substantially wrinkle free.

* * * * *